US005368152A

United States Patent [19]

Rhodes

[11] Patent Number: 5,368,152

[45] Date of Patent: Nov. 29, 1994

[54] IMPROVEMENT IN CONVEYOR CHAIN ENGAGEMENT PIN IN CONVEYING SYSTEM FOR MOVING LOAD CARRYING UNITS

[76] Inventor: Arthur B. Rhodes, 3347 Campground Rd., Louisville, Ky. 40211

[21] Appl. No.: 131,314

[22] Filed: Oct. 4, 1993

[51] Int. Cl.[5] ..... B65G 29/00

[52] U.S. Cl. ..... 198/465.1; 104/172.2

[58] Field of Search ..... 198/345.3, 465.1, 465.2, 198/803.01; 104/88, 172.2, 172.3

[56] References Cited

U.S. PATENT DOCUMENTS

| | | | |
|---|---|---|---|
| 3,810,428 | 5/1974 | Klamp | 104/172.2 |
| 4,179,993 | 12/1979 | Sleep | 104/172.2 |
| 4,297,950 | 11/1981 | Funk et al. | 104/172.2 |
| 4,438,702 | 3/1984 | Rhodes | 104/172 B |
| 4,638,740 | 1/1987 | Rhodes | 104/172.2 |
| 4,644,869 | 2/1987 | Rhodes | 104/172.2 |
| 4,770,285 | 9/1988 | Rhodes | 198/378 |
| 4,787,802 | 11/1988 | Vaccaro et al. | 104/172.2 X |
| 4,944,228 | 7/1990 | Rhodes | 104/172.3 |
| 4,947,978 | 8/1990 | Rhodes | 198/465.1 X |
| 5,065,678 | 11/1991 | Rhodes | 104/88 |

*Primary Examiner*—James R. Bidwell
*Attorney, Agent, or Firm*—Charles G. Lamb

[57] ABSTRACT

A load carrying unit for use along a predetermined conveying track including an endless moving conveyor chain. The load carrying unit is provided with a depending vertically movable conveyor chain engagement pin which is selectively movable between a conveyor chain engaged position coupling the load carrying unit to the conveyor chain so that the load carrying unit moves with the conveyor chain, and a conveyor chain disengaged position uncoupling the load carrying unit from the conveyor chain. The device for disengaging the movable pin from the conveyor chain includes an elongated pivotally attached horizontal bar extending transversely along the front end of the load carrying unit and spaced forwardly therefrom and engagable with a rear end of a downstream load carrying unit which pivots the elongated bar inwardly toward the load carrying unit. The elongated bar engages a pin actuator which lifts the pin out of engagement with the chain conveyor and also engages a pin stabilizer which comprises a compression spring actuated on one end in response to movement of the elongated bar and a second end of the spring contacts a horizontal movable rod which in turns contacts the chain engagement pin in the disengaged position. Through friction contact the rod holds the chain engagement pin in a disengaged position being so long as the elongated bar is engaged with the rear end of the downstream load carrying unit.

5 Claims, 2 Drawing Sheets

IMPROVEMENT IN CONVEYOR CHAIN ENGAGEMENT PIN IN CONVEYING SYSTEM FOR MOVING LOAD CARRYING UNITS

BACKGROUND OF THE INVENTION a) Field of the Invention

This invention relates to conveyor systems for moving load carrying units, such as carts or pallets along a path defined by a conveyor system. More particularly, the invention relates to a load carrying unit including a vertically movable pin for engagement with an endless chain of a conveyor system. Even more particularly, the invention is directed to a stabilizing means for stabilizing vertically movable engaging pins of a load carrying unit when the pin is in a disengaged position.

b) Description of the Prior Art

Conveying systems for moving work pieces from work station to work station including conveyors which generally move at a constant speed and include load carrying units which can be coupled for movement therewith between work stations and uncoupled from the conveyor so that they will be stationary at the work stations while work is done on a work piece carried by the load carrying units are well known. Examples for these conveying systems are set forth in a number of U.S. patents including U.S. Pat. Nos. 4,438,702; 4,644,869; 4,638,740; 4,770,285; and, 5,065,678.

In these conveyor systems, the load carrying units are provided with vertically movable pins for engaging and disengaging with movable endless chains which move at a constant and continuous speed. Many different means have been used for moving these vertical pins from an engaging to a disengaging position and problems have been encountered in maintaining these pins in a disengaged position as the endless chain continues to move beneath the pins. U.S. Pat. No. 4,944,228 teaches one means for stabilizing the engaging pins in a disengaged position.

SUMMARY OF THE INVENTION

The object of the present invention is to provide an improved means for engaging and disengaging a load carrying unit from a conveyor system utilizing an endless chain conveyor. Another object of the present invention is to provide a pin stabilizing means for a vertically movable chain engaging pin when in a disengaged position.

More particularly, the present invention provides a load carrying unit for selected movement along a conveying path defined by an endless conveyor chain comprising:

a frame structure having a front end and a back end;

floor engaging wheels rotably attached to the frame structure;

a depending movable conveyor chain engagement pin attached to the frame structure near the front end of the frame structure movable between a lowered chain engaged position whereat the depending end of the pin engages a conveyor chain and a raised, disengaged position whereat the depending end of the pin is spaced above and out of contact with the conveyor chain;

pin moving means structurally associated with the pin and mounted to the front end of the frame structure for pivotable movement about an axis perpendicular to the longitudinal axis of the pin to move the pin between the lowered chain engaged position and raised chain disengaged position;

an elongated bar extending transverse of said front end of said load carrying unit and spaced forwardly therefrom, said elongated bar being pivotally attached to said frame on opposite sides of said front end, said bar being in contacting relation with said pin moving means; and pin stabilizing means comprising compression means actuated in response to movement of said elongated bar and means to hold said chain engagement pin in a disengaged position, said means to hold said chain engagement pin operable in response to said compression means.

BRIEF DESCRIPTION OF THE DRAWINGS

A better understanding of the present invention will be had upon reading the following description in conjunction with the accompanying drawings in which like parts are identified by like number and wherein.

DETAILED DESCRIPTION OF THE PREFERRED EMBODIMENT

Figure 1:
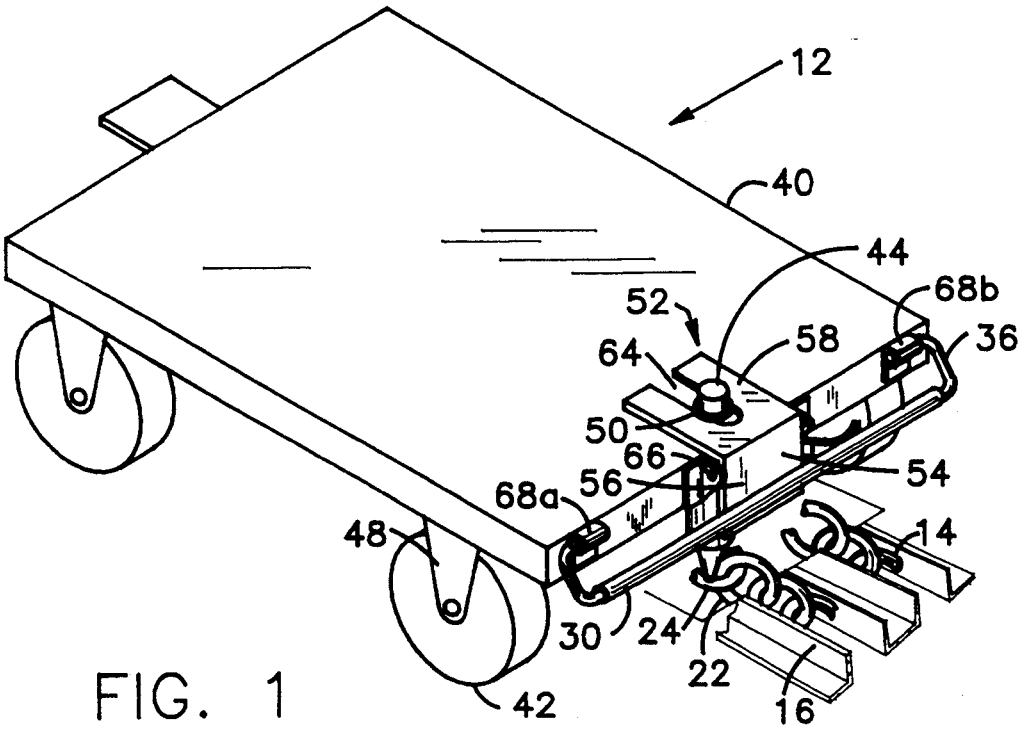
FIG. 1 is a perspective view of a load carrying unit of the present invention used with an endless chain conveyor system.

FIG. 1 is a perspective view of a load carrying unit 12 used with a conveyor system, such as that shown and described in U.S. Pat. No. 4,944,228. The load carrying unit 12 is shown as a wheeled cart which comprises a frame structure 40 and floor engaging wheels 42 rotatably mounted with wheel mounting bracket 48 to the frame structure 40. Frame structure 40 can be of virtually any construction and configuration to support a load to be carried and conveyed on the cart 12.

A depending movable conveyor chain engagement pin 44 is attached to the cart frame 40 near the front end of the cart 12. The movable chain engagement pin 44 is movable between a lowered, conveyor chain engaging position (shown in solid lines in FIG. 2) and a raised, vertically displaced conveyor chain disengaged position (shown in broken lines in FIG. 2). In the lowered, conveyor chain engagement position a depending tapered tip 44*a* of the pin 40 is received in the opening of one of the horizontal lengths 24 of the endless conveyor chain 14, and in the raised conveyor chain disengaged position the depending tapered tip 44*a* of pin 44 is spaced a distance above and out of contact with the conveyor chain 14 so that the conveyor chain 14 moves beneath the depending end 44*a* of the pin 44 in the chain guide channels 16.

Various constructions can be used to movably attach the movable pin 44 to the cart frame structure 40. Shown in FIG. 2, the movable pin 44 is axially, slidably received through a hole 46 in the frame 40 to depend vertically from the frame 40. A portion of the pin 44 also extends above the frame 40, and a keeper 50 is attached to the pin 44 proximate the upwardly extending end thereof. Movable pin activating means 52 is provided for selectively moving the pin 44 between the conveyor chain engaged position and conveyor chain disengaged position. The pin activating means 52 is shown as comprising a pivotable right angle plate 54 located at the front of the cart 12 in front of the pin 44. The angled plate includes a first arm 56 and a second arm 58 at a right angle to the first arm 56. A pivotal axle 60 is located across the plate 54 at the junction of the first arm 56 and second arm 58 and is affixed thereto so that the plate 54 will move with axle 60 as it rotates. The opposite ends of the axle 60 extend beyond the opposite lateral sides of plate 54 and are received in appropriate holes 66 in the frame 40 for rotational movement therein. The first arm 56 depends from the axle 60 at the front of the cart 12 and the second arm extends back from the axle 60 to the location of the movable pin 44. The second arm 58 is formed with an elongated opening 64. The upwardly extending portion of the pin 44 is received in the elongated opening 64 with the keeper 50 located above the second arm so that it is in abutment with the top side of the second arm 58. The conveyor engagement pin 44 is biased to the lower conveyor chain engagement position by the force of gravity.

Figure 2:
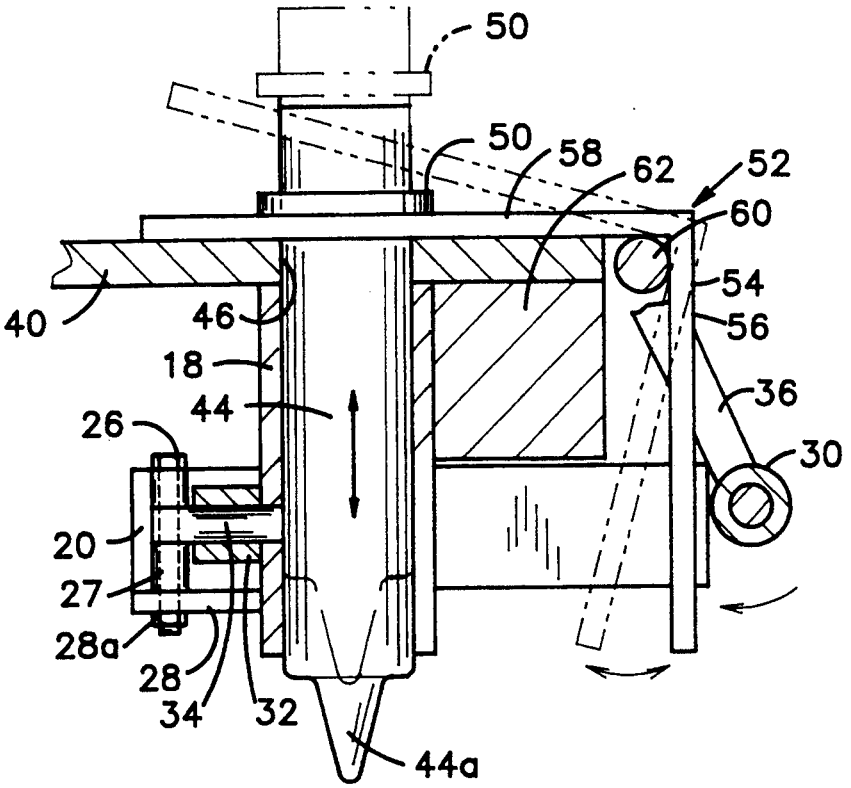
FIG. 2 is an enlarged side view of an element of the load carrying unit as seen in the direction of arrows 2—2 in FIG. 1.
Figure 3:
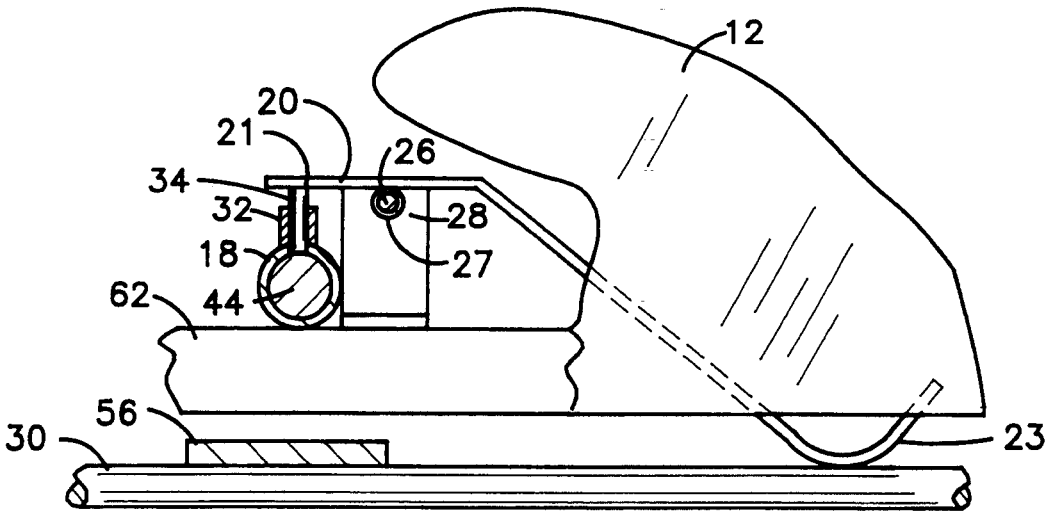
FIG. 3 is an enlarged perspective view of another element of the load carrying unit of FIG. 1; and, FIG. 4 shows an underview of the element of the load carrying unit of FIG. 3.
Figure 4:
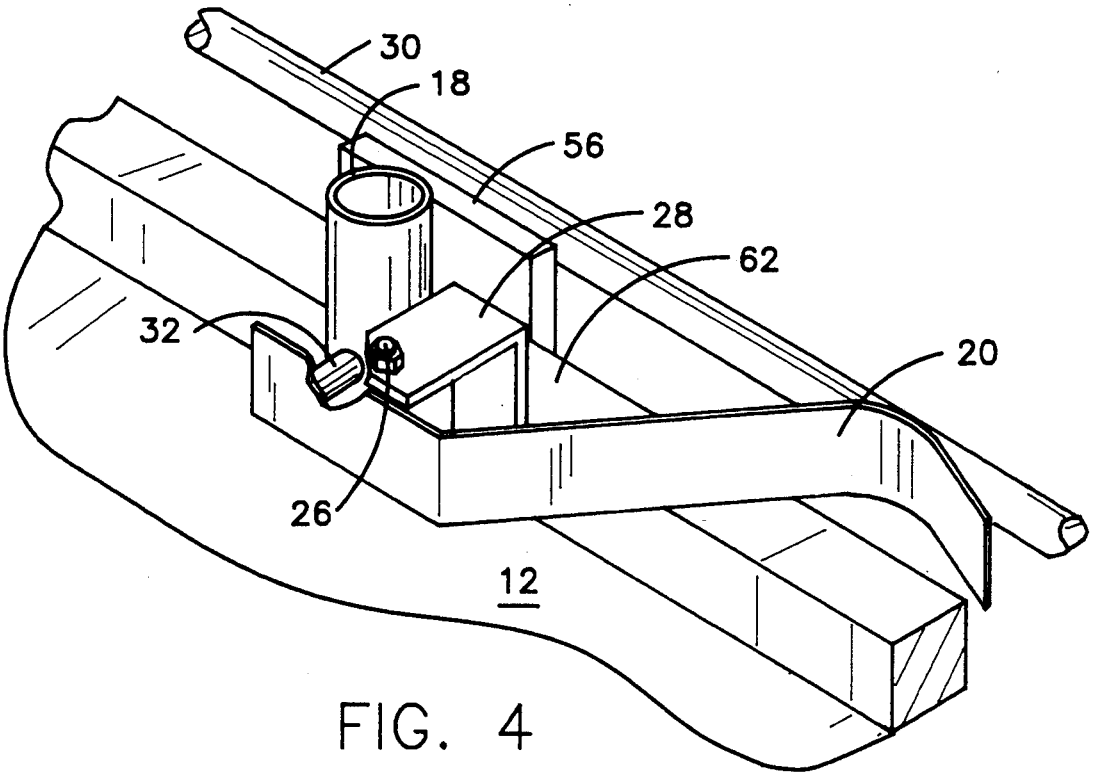

As shown in FIGS. 2, 3 and 4, the first arm 56 of the movable pin activating means 52 is movable in response to a safety bar 36 which extends forwardly beyond the first arm 56 of the wheeled cart 12 wherein the safety bar 36 is pivotally attached on opposite sides of the forward portion of the frame structure 40. The safety bar 36 is attached to the frame structure 40 by transversely extending sleeves **68*a* and 68*b* which are spaced on opposite sides of the front portion of the frame structure 40**.

The pin activating means 52 also includes means to stabilize the pin 44 when the pin 44 is in a disengaged position. The means to stabilize the pin 44 in a disengaged position includes biasing means, such as compression spring 20, which is in contact with a horizontally extending movable rod 34 at one end and is activated in response to movement of the safety bar 36 on the other. The compression spring 20 is welded to a vertically extending sleeve 27 which is mounted onto an L-shaped support plate 28. Bolt 26 extends through sleeve 27 and an aperture **28*a* in one leg of the L-shaped support plate 28 to hold rotatable sleeve 27 thereon. The L-shaped support plate 28 is in turn welded to the frame structure 40 of the wheeled cart 12. The sleeve 27 is freely rotatable so that upon movement of the safety bar 36 the rotational movement of the sleeve 27 allows the end 21 of the spring 20 to push the movable rod 34 inwardly into the tube 18 thereby contacting the movable chain engagement pin 44. An outwardly extending collar 32 which is welded to the tube 18 is provided to receive the movable rod 34** therethrough.

In operation, when the wheeled cart 12 is in abutting relation with a downstream wheeled cart 12 in a conveying system, the safety bar 36, which may include a covering 30 thereon, engages the rearward portion of the frame structure 40 of a downstream cart 12 and pivots rearwardly engaging the first arm 56 of the movable activating means 52 thereby raising the second arm 58 which engages with the keeper 50 of the pin 44. Thus, the movable chain engagement pin 44 moves in an upwardly position and the tapered tip **44*a* of pin 44 is removed from the endless chain 14. The safety bar 36 also engages the compression spring 20 thereby forcing the end 23 inwardly and the opposed end 21 engages the movable rod 34 to move the movable rod in contacting relation with the pin 44. Pin 44 is frictionally held in a disengaged position as long as the movable rod 34 is in contacting relation therewith. Thus, even though there is movement of the downstream wheeled cart 12 or the present movable cart 12 causing increased spacing therebetween, during this movement or jostling of the carts, the compression spring 20 may increase or decrease the compression on the pin movable rod 34. However, since the movable pin 44 is held by friction, the pin 44 will still be kept in a disengaged nonmovable position even though the keeper 50 may fluctuate between engaging and disengaging contact with the second arm 58 of the movable pin activating means 52**.

The foregoing detailed description is given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A load carrying unit for selected movement along a conveying path defined by an endless conveyor chain, comprising:

a frame structure having a front end and a back end;

floor engaging wheels rotatably attached to the frame structure;

a depending movable conveyor chain engagement pin attached to the frame structure near the front end of the structure movable between a lowered chain engaged position whereat the depending end of the pin engages the conveyor chain and a raised, chain disengaged position whereat the depending end of the pin is spaced above and out of contact with the conveyor chain;

pin moving means structurally associated with the pin and mounted to the front end of the frame structure for pivotal movement about an axis perpendicular to the longitudinal axis of the pin to move the pin between the lower chain engaged position and raised chain disengaged position;

an elongated bar extending transverse of said front end of said load carrying unit and spaced forward therefrom, said elongated bar being pivotally attached to said frame on opposite sides of said front end, said elongated bar being in contacting relation with said pin moving means; and, pin stabilizing means comprising compression means actuated in response to movement of said elongated bar and said pin moving means to hold said chain engagement pin in a disengaged position, said means to hold said engagement pin in a disengaged position operable in response to said compression means.

2. The load carrying unit of claim 1, said compression means being a compression spring.

3. The load carrying unit of claim 1, said means to hold said engagement pin in a disengaged position including a horizontally disposed movable rod having one end in contacting relation with said compression means and a second end opposite said one end in contacting relation with said chain engagement pin.

4. The load carrying unit of claim 1 further comprising:

a sleeve attached to the front end of the frame structure; and, said chain engagement pin is received in the sleeve for movement in the sleeve between the lowered chain engaged position and the raised chain disengaging position.

5. The load carrying unit of claim 1 wherein the depending end of the pin is tapered.

* * * * *